US011231054B2

(12) United States Patent
Veit

(10) Patent No.: US 11,231,054 B2
(45) Date of Patent: Jan. 25, 2022

(54) HYDRAULIC DRIVE SYSTEM FOR A CONSTRUCTION MATERIAL PUMP, AND CONSTRUCTION MATERIAL PUMP

(71) Applicant: Putzmeister Engineering GmbH, Aichtal (DE)

(72) Inventor: Jan-Martin Veit, Pliezhausen (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 17/251,661

(22) PCT Filed: Jun. 7, 2019

(86) PCT No.: PCT/EP2019/064944
§ 371 (c)(1),
(2) Date: Dec. 11, 2020

(87) PCT Pub. No.: WO2019/238559
PCT Pub. Date: Dec. 19, 2019

(65) Prior Publication Data

US 2021/0164497 A1 Jun. 3, 2021

(30) Foreign Application Priority Data

Jun. 14, 2018 (DE) ..... 10 2018 209 513.2

(51) Int. Cl.
*F15B 15/20* (2006.01)
*F04B 15/02* (2006.01)
*E04G 21/02* (2006.01)

(52) U.S. Cl.
CPC ..... *F15B 15/20* (2013.01); *F04B 15/02* (2013.01); *E04G 21/02* (2013.01)

(58) Field of Classification Search
CPC ..... F15B 15/20; F15B 2211/20561; F15B 2211/7114; F15B 2211/7121; F15B 2211/128; F04B 15/02; E04G 21/04
See application file for complete search history.

(56) References Cited

U.S. PATENT DOCUMENTS 6,929,454 B2 * 8/2005 Munzenmaier ..... F04B 9/1178 417/342
7,322,802 B2 * 1/2008 Benckert ..... F04B 15/02 417/399

(Continued)

FOREIGN PATENT DOCUMENTS

DE 101 34 789 A1 1/2003
DE 10134789 A1 * 1/2003 ..... F16H 61/46

(Continued)

OTHER PUBLICATIONS

International Search Report (PCT/ISA/210) issued in PCT Application No. PCT/EP2019/064944 dated Aug. 1, 2019 with English translation (five (5) pages).

(Continued)

*Primary Examiner* — Thomas E Lazo
(74) *Attorney, Agent, or Firm* — Crowell & Moring, LLP

(57) ABSTRACT

A hydraulic drive system for a construction material pump has a hydraulic circuit for hydraulic fluid, a feed pump which is designed to feed hydraulic fluid into the hydraulic circuit, at least one controllable pressure-limiting valve unit, which is designed for variable adjustment of a limit pressure of hydraulic fluid of at least one portion of the hydraulic circuit within a pressure range, and a control unit. The control unit is designed to control the pressure-limiting valve unit according to at least one operating parameter of the hydraulic drive system and/or according to the hydraulic fluid in such a way that the pressure-limiting valve unit (Continued)

adjusts the limit pressure of the portion of the hydraulic circuit.

16 Claims, 2 Drawing Sheets

(56) References Cited

U.S. PATENT DOCUMENTS

| | | | | |
|---|---|---|---|---|
| 7,401,466 | B2 * | 7/2008 | Von Baeumen | F04B 9/1178 60/394 |
| 9,334,884 | B2 * | 5/2016 | Stuermer | F15B 15/20 |
| 10,273,984 | B2 | 4/2019 | Veit et al. | |
| 2015/0096290 | A1 * | 4/2015 | Veit | F04B 49/06 60/421 |
| 2015/0330374 | A1 * | 11/2015 | Hudelmaier | F04B 11/005 137/1 |

FOREIGN PATENT DOCUMENTS

| | | | |
|---|---|---|---|
| DE | 10 2009 021 833 | A1 | 11/2010 |
| DE | 10 2009 047 732 | A1 | 6/2011 |
| DE | 10 2010 045 541 | A1 | 3/2012 |
| EP | 0 562 398 | A1 | 9/1993 |
| ER | 2 855 945 | B1 | 3/2018 |
| JP | 59-226288 | A | 12/1984 |

OTHER PUBLICATIONS

German-language Written Opinion (PCT/ISA/237) issued in PCT Application No. PCT/EP2019/064944 dated Aug. 1, 2019 (five (5) pages).

* cited by examiner

HYDRAULIC DRIVE SYSTEM FOR A CONSTRUCTION MATERIAL PUMP, AND CONSTRUCTION MATERIAL PUMP

FIELD OF USE AND PRIOR ART

The invention relates to a hydraulic drive system for a construction material pump, and to a construction material pump having a hydraulic drive system of said type.

Problem and Solution

The invention is based on the problem of providing a hydraulic drive system for a construction material pump and a construction material pump having a hydraulic drive system of said type, which hydraulic drive system and construction material pump each have improved properties.

The invention solves said problem through the provision of a hydraulic drive system and a construction material pump having the features of the independent claims. Advantageous refinements and/or configurations of the invention are described in the dependent claims.

The hydraulic drive system according to the invention for a construction material pump has a hydraulic circuit, a, in particular at least one, feed pump, at least one in particular electrically controllable pressure limiting valve unit and an in particular electrical control unit. The hydraulic circuit is designed for hydraulic fluid, in particular oil. The in particular at least one feed pump is designed for in particular automatically feeding hydraulic fluid into the hydraulic circuit. The pressure limiting valve unit is designed for the in particular automatic, variable or changeable or closed-loop-controllable setting in particular of a, in particular of at least one, limit pressure, in particular of a limit pressure value or limit pressure magnitude, of hydraulic fluid of at least one section of the hydraulic circuit within a pressure range, in particular a pressure value range, in particular in or during operation of the hydraulic drive system, in particular conveying operation of the construction material pump. The control unit is designed to in particular automatically control the pressure limiting valve unit in a manner dependent on at least one in particular user-demanded operating parameter, in particular an operating parameter value or operating parameter magnitude, of the hydraulic drive system and/or of hydraulic fluid, such that the pressure limiting valve unit in particular variably sets the limit pressure of the section of the hydraulic circuit.

This allows demand-dependent or adaptive setting or adaptation, in particular a reduction, of the limit pressure. The feed pump may have to overcome or work against the limit pressure. This thus allows demand-dependent energy or power consumption of the feed pump, in particular a reduction of the energy or power consumption of the feed pump. This thus allows a saving of energy or power.

In particular in the event of a change of the at least one operating parameter or of the value thereof, the limit pressure or the value thereof may be in particular actively changed. In addition or alternatively, in the absence of a change of the operating parameter or of its value, the limit pressure or the value thereof does not need to be changed. In other words: in the absence of a change of the operating parameter, the limit pressure or the value thereof may be set to be constant or may be kept constant or may be left unchanged. In other words: the limit pressure or the value thereof and the at least one operating parameter or the value thereof may be linked to one another, in particular by means of a function.

The hydraulic circuit may have at least one hydraulic line, in particular a pipe and/or a hose.

The hydraulic drive system may have a container or tank, in particular a reservoir, for or with hydraulic liquid. The feed pump may be designed for feeding in hydraulic fluid from the container. In addition or alternatively, the feed pump may be a constant-displacement pump. It is furthermore additionally or alternatively possible for the feed pump to be designed for directly and/or indirectly feeding into the at least one section.

The pressure limiting valve unit may be referred to as a closed-loop pressure control unit. In particular, the hydraulic drive system may have at least one in particular electrical pressure sensor. The pressure sensor may be designed for in particular automatic measurement, in particular closed-loop control, of the limit pressure, in particular of the limit pressure value or limit pressure magnitude, of hydraulic fluid in the section of the hydraulic circuit. The control unit and/or the pressure limiting valve unit may be designed for the setting, in particular closed-loop control, of the limit pressure in a manner dependent on the measured limit pressure. In particular, the control unit and/or the pressure limiting valve unit may in particular each have an in particular electrical signal connection to the pressure sensor. Alternatively or in addition, this may be referred to as closed-loop pressure control. Further additionally or alternatively, the pressure limiting valve unit may be designed for setting the limit pressure to at least three different limit pressure values. In particular, the pressure limiting valve unit may be designed for setting of the limit pressure in pressure value steps of at most 5 bar, in particular of at most 4 bar, in particular of at most 3 bar, in particular of at most 2 bar, in particular of at most 1 bar, in particular for continuous setting. Further additionally or alternatively, the pressure range may have or be defined by a minimum limit pressure value and a maximum limit pressure value.

The operating parameter or the value thereof can be varied in stages, in particular in continuous fashion.

The control unit may have a user-operable operator control panel for the operator control of the hydraulic drive system, in particular of the construction material pump, in particular an input unit for user input or user selection of the at least one operating parameter or of the value thereof. In addition or alternatively, the control unit may be designed for in particular automatically determining or ascertaining, in particular calculating, the limit pressure or the value thereof in a manner dependent on the at least one operating parameter. In other words, the limit pressure may be dependent on the at least one operating parameter and/or must have a particular or required value in order to attain the in particular user-demanded operating parameter. In particular, the control unit may have a processor and/or a memory. Further additionally or alternatively, the control unit may have an in particular electrical signal connection to the pressure limiting valve unit.

In one refinement of the invention, the hydraulic drive system has a drive motor. The drive motor is designed for in particular automatically driving the feed pump. The demand-dependent setting of the limit pressure or of the value thereof allows demand-dependent energy or power consumption of the drive motor. In particular, the drive motor may be an internal combustion engine, in particular a diesel engine, or an electric motor.

In one refinement of the invention, the at least one operating parameter is a drive state, a drive flow, a drive pressure, a drive rotational speed, a cooling flow, a temperature and/or a degree of contamination. In particular, the drive state may be on or off or drive or non-drive, in particular of the construction material pump. In an off drive state, the limit pressure may be lowered in particular to the minimum limit pressure value. Additionally or alternatively, the drive flow and/or the drive pressure may each have an in particular variable value or magnitude and/or be an operating parameter of the hydraulic fluid. Further additionally or alternatively, the drive rotational speed may have an in particular variable value or magnitude and/or be an operating parameter of the feed pump and/or of the drive motor, if present. Further additionally or alternatively, the cooling flow, the temperature and/or the degree of contamination may each have an in particular variable value or magnitude and/or be an operating parameter of the hydraulic fluid.

In one refinement of the invention, the pressure range extends or is from a minimum of 2.5 bar to a maximum of 40 bar, in particular from a minimum of 5 bar to a maximum of 35 bar, in particular from a minimum of 10 bar to a maximum of 30 bar, in particular from a minimum of 15 bar to a maximum of 25 bar.

In one refinement of the invention, the at least one pressure limiting valve unit has a, in particular at least one, in particular electrically controllable proportional pressure limiting valve. The proportional pressure limiting valve is designed for, in particular automatically, continuously setting the limit pressure, in particular the value thereof, of hydraulic fluid of the at least one section of the hydraulic circuit within the pressure range. The control unit is designed to in particular automatically control the proportional pressure limiting valve in a manner dependent on the at least one operating parameter such that the proportional pressure limiting valve in particular continuously sets the limit pressure of the section of the hydraulic circuit. In particular, the proportional pressure limiting valve can be referred to as proportional closed-loop pressure control valve.

In one refinement of the invention, the at least one section of the hydraulic circuit has a feed pressure section for hydraulic fluid. The at least one pressure limiting valve unit has an in particular electrically controllable feed pressure limiting valve unit. The feed pressure limiting valve unit is designed for, in particular automatically, variably setting a feed limit pressure, in particular a feed limit pressure value or a feed limit pressure magnitude, of hydraulic fluid of the feed pressure section within the pressure range. In particular, the control unit may be designed to in particular automatically control the feed pressure limiting valve unit in a manner dependent on the at least one operating parameter such that the feed pressure limiting valve unit in particular variably sets the feed limit pressure of the feed pressure section. The feed limit pressure or the value thereof may be dependent on the drive state, the drive flow, the drive pressure, the drive rotational speed, the cooling flow, the temperature and/or the degree of contamination, if present. Additionally or alternatively, the feed pressure limiting valve unit may be referred to as closed-loop feed pressure control unit. Further additionally or alternatively, the feed pump may be designed for directly feeding into the feed pressure section.

In one refinement of the invention, the hydraulic drive system has a, in particular at least one, variably adjustable drive pump and at least one in particular electrically controllable hydraulic pressure-based actuator. The drive pump is designed for in particular automatically generating a, in particular the, variable drive flow, in particular with a variable drive flow value or drive flow magnitude, with a, in particular the, variable drive pressure, in particular with a variable drive pressure value or drive pressure magnitude, of hydraulic fluid in at least one drive pressure section of the hydraulic circuit. The actuator is designed for, in particular automatically, variably adjusting the drive pump by means of a variable actuating pressure, in particular with a variable actuating pressure value or actuating pressure magnitude, of hydraulic fluid. The at least one section, in particular the feed pressure section, if present, of the hydraulic circuit is designed for the in particular automatic hydraulic pressure supply of the at least one actuator with hydraulic fluid with the set limit pressure, in particular the set feed limit pressure, if present, for the actuating pressure. The control unit is designed to in particular automatically control the at least one actuator in a manner dependent on the at least one operating parameter such that the at least one actuator in particular variably adjusts the drive pump for the generation of the variable drive flow with the variable drive pressure of hydraulic fluid in the at least one drive pressure section.

In particular, the drive pressure section may be referred to as high pressure and/or low pressure section. Additionally or alternatively, the drive pressure section may differ from the feed pressure section, if present. In particular, the feed pressure section may be designed for feeding hydraulic fluid into the drive pressure section, in particular by means of at least one infeed check valve of the hydraulic drive system. In other words, the feed pump may be designed for indirectly feeding into the drive pressure section.

Further additionally or alternatively, the drive rotational speed, if present, may be an operating parameter of the drive pump. In particular, the drive motor may be designed for in particular automatically driving the drive pump.

Further additionally or alternatively, the actuating pressure may be dependent on the operating parameter, in particular on the drive state, the drive flow, the drive pressure and/or the drive rotational speed, and/or must have a particular or required value in order to attain the in particular user-demanded operating parameter. In particular, the control unit may be designed for in particular automatically determining or ascertaining, in particular calculating, the actuating pressure or the value thereof in a manner dependent on the at least one operating parameter.

Further additionally or alternatively, the limit pressure, in particular the feed pressure, if present, may be dependent on the actuating pressure and/or must have a particular or required value in order to attain the actuating pressure. In particular, the control unit may be designed for in particular automatically determining or ascertaining, in particular calculating, the limit pressure or the value thereof in a manner dependent on the actuating pressure. Further additionally or alternatively, the control unit may have an in particular hydraulic signal connection to the actuator.

In particular, in an off drive state, if present, the drive pump only needs to generate a relatively small drive flow or even no drive flow. Thus, only a relatively low actuating pressure, or no actuating pressure may be required for the adjustment of the drive pump. Thus, the limit pressure can be lowered, in particular to the minimum limit pressure value. The minimum limit pressure value may make it possible to maintain a function of the drive pump or prevent damage to the drive pump. In an on drive state, if present, a relatively high actuating pressure may be required, in particular in a manner dependent on the drive flow, the drive pressure and/or the drive rotational speed. A relatively high limit pressure may thus be required.

Further alternatively or in addition, the drive pump may be an axial piston pump with variably adjustable swept volume. The at least one actuator may be designed for, in particular automatically, variably adjusting the swept volume.

In one configuration of the invention, the drive pump is an axial piston pump with variably adjustable swashplate. The at least one actuator is designed for, in particular automatically, variably adjusting the swashplate. In particular, a pivot angle of the swashplate may be dependent on the operating parameter, in particular on the drive state and/or the drive flow, and/or must have a particular or required value in order to attain the in particular user-demanded operating parameter. In particular, the control unit may be designed for in particular automatically determining or ascertaining, in particular calculating, the pivot angle or the value thereof in a manner dependent on the at least one operating parameter.

In one configuration of the invention, the hydraulic drive system has at least one drive cylinder and an associated drive piston, which is in particular arranged in the drive cylinder. The drive pump is designed for, in particular automatically, variably moving the at least one drive piston, in particular in the drive cylinder, by generating the drive flow of hydraulic fluid. In particular, the hydraulic drive system may have at least one pump line. The drive pump and the drive cylinder may be connected by means of the pump line for a flow of hydraulic fluid, in particular between the drive pump and the drive cylinder. Additionally or alternatively, the drive piston may be designed for applying pressure with hydraulic fluid. Further additionally or alternatively, the control unit may be designed to in particular automatically control the movement of the drive piston in a manner dependent on the at least one operating parameter.

In one refinement, the hydraulic drive system has at least two drive cylinders and respectively associated drive pistons, which are in particular arranged in the respective drive cylinder, and an oscillation line for hydraulic fluid. The drive pump and the two drive cylinders form, by means of the oscillation line, a closed drive circuit for hydraulic fluid. The two drive pistons are coupled, in particular in antiphase, by means of the oscillation line. In particular, the two drive cylinders may be connected by means of the oscillation line for a flow of hydraulic fluid, in particular between the drive cylinders. Additionally or alternatively, the hydraulic drive system may have at least two pump lines. The drive pump and the two drive cylinders may, by means of the oscillation line and the two pump lines, form the closed drive circuit for hydraulic fluid. In particular, the drive pump and one of the two drive cylinders may be connected by means of one of the two pump lines for a flow of hydraulic fluid, in particular between the drive pump and the drive cylinder. The drive pump and another of the two drive cylinders may be connected by means of another of the two pump lines for a flow of hydraulic fluid, in particular between the drive pump and the drive cylinder. Further additionally or alternatively, the drive pump or the closed drive circuit may have a high pressure side and a low pressure side, in particular which may be cyclically interchanged with one another, in particular in or during operation of the hydraulic drive system, in particular conveying operation of the construction material pump. In particular, the drive pressure may be referred to as high pressure, in particular of the high pressure side. A low pressure or low limit pressure, in particular of the low pressure side, may be produced or generated by the feed pump, in particular the feed limit pressure, if present. The drive pressure or high pressure or the value thereof may be higher than the low pressure or low limit pressure or the value thereof. In particular, a closed drive circuit may refer to a flow of hydraulic fluid from the drive pump, in particular the high pressure side thereof, through one pump connection, one drive cylinder, the oscillation connection, the other drive cylinder, the other pump connection to the drive pump, in particular the low pressure side thereof.

In one refinement of the invention, the at least one section of the hydraulic circuit has at least one low pressure section for hydraulic fluid. The at least one pressure limiting valve unit has an in particular electrically controllable low pressure limiting valve unit. The low pressure limiting valve unit is designed for, in particular automatically, variably setting a low limit pressure, in particular a low limit pressure value or low limit pressure magnitude, of hydraulic fluid of the at least one low pressure section within the pressure range. In particular, the control unit may be designed to in particular automatically control the low pressure limiting valve unit in a manner dependent on the at least one operating parameter such that the low pressure limiting valve unit in particular variably sets the low limit pressure of the at least one low pressure section. The low limit pressure or the value thereof may be dependent on the cooling flow, the temperature and/or the degree of contamination, if present. Additionally or alternatively, the low pressure limiting valve unit may be referred to as closed-loop low pressure control unit. Further additionally or alternatively, the low pressure section may be referred to as drive pressure section. Further additionally or alternatively, the low pressure section may differ from the feed pressure section, if present. In particular, the feed pressure section may be designed for feeding hydraulic fluid into the low pressure section, in particular by means of at least one infeed check valve of the hydraulic drive system. In other words: the feed pump may be designed for indirectly feeding into the low pressure section. In other words: the low limit pressure or the value thereof may be lower than the feed limit pressure or the value thereof. Further additionally or alternatively, the hydraulic drive system may have a shuttle-type purge valve. The low pressure section and the low pressure limiting valve unit may be connected by means of the shuttle-type purge valve for a flow of hydraulic fluid, in particular from the low pressure section to the low pressure limiting valve unit.

In one refinement of the invention, the hydraulic drive system has a cooler. The cooler is designed for in particular automatically cooling hydraulic fluid. The at least one pressure limiting valve unit is designed for, in particular automatically, variably setting a, in particular the, cooling flow of hydraulic fluid via or through the cooler by setting the limit pressure. The control unit is designed to in particular automatically control the pressure limiting valve unit in a manner dependent on the at least one operating parameter, in particular the temperature, if present, such that the pressure limiting valve unit in particular variably sets the cooling flow of hydraulic fluid via the cooler. This allows demand-dependent or adaptive setting or adaptation, in particular a reduction, of the cooling flow. This thus allows demand-dependent energy or power consumption of the feed pump, in particular a reduction of the energy or power consumption of the feed pump. In particular, the cooling flow or the value thereof may be set or defined by means of or by a pressure difference between the feed limit pressure and the low limit pressure, if present. In other words, the low limit pressure may be set in a manner dependent on the in particular required cooling flow and the in particular required feed limit pressure. Additionally or alternatively, the hydraulic drive system may be designed for the purging or outfeed of the cooling flow out of the hydraulic circuit, in particular out of the section, in particular the low pressure section, in particular of the closed drive circuit, if present, via the cooler.

In one refinement of the invention, the at least one pressure limiting valve unit is designed for variably setting the limit pressure by in particular automatic and/or variable purging or outfeed of hydraulic fluid out of the hydraulic circuit, in particular out of the section, in particular to the feed pump and/or into the container, if present. In particular, the pressure limiting valve unit may be designed as a throttle valve unit.

In one refinement of the invention, the hydraulic drive system has at least one in particular electric measuring sensor. The measuring sensor is designed for in particular automatically measuring at least one property, in particular a value or magnitude of the property, and/or a, in particular the, temperature and/or a, in particular the, degree of contamination, of the hydraulic drive system and/or of hydraulic fluid. The control unit is designed to in particular automatically determine the at least one operating parameter in a manner dependent on the measured property. In particular, the control unit may have an in particular electrical signal connection to the measuring sensor. Additionally or alternatively, the operating parameter may correspond to or be the measured property.

The invention furthermore relates to a construction material pump. The construction material pump according to the invention has a construction material conveying unit and the hydraulic drive system. The construction material conveying unit is designed for in particular automatically conveying construction material. The hydraulic drive system is designed for in particular automatically driving the construction material conveying unit.

The construction material pump may allow the same advantages as the hydraulic drive system described above.

In particular, the construction material pump or the construction material conveying unit or the construction material may have at least one in particular variable or changeable conveying parameter, in particular with a value or magnitude. In particular, the at least one conveying parameter may be a conveying state, a conveying flow and/or a conveying pressure. Additionally or alternatively, the at least one operating parameter may be dependent on the at least one conveying parameter and/or must have a particular or required value in order to attain the in particular user-demanded conveying parameter. In particular, the drive state may be dependent on the conveying state, the drive flow may be dependent on the conveying flow and/or the drive pressure may be dependent on the conveying pressure, if present. In other words: the control unit may be designed for in particular automatically determining or ascertaining, in particular calculating, the at least one operating parameter or the value thereof in a manner dependent on the at least one conveying parameter. Further additionally or alternatively, the control unit may have a user-operable operator control panel for the operator control of the construction material pump or of the hydraulic drive system, in particular an input unit for user input or user selection of the at least one conveying parameter or of the value thereof.

Further additionally or alternatively, the construction material pump may be referred to as a concrete pump or thick matter pump. Thick matter may refer to mortar, cement, screed, concrete, plaster and/or sludge.

Further additionally or alternatively, the device may be designed as a mobile device, in particular as a truck-mounted construction material pump.

BRIEF DESCRIPTION OF THE DRAWINGS

Further advantages and aspects of the invention will emerge from the claims and from the following description of preferred exemplary embodiments of the invention, which are discussed below on the basis of the figures.

DETAILED DESCRIPTION OF THE EXEMPLARY EMBODIMENTS

The construction material pump 200 has a construction material conveying unit 210 and a hydraulic drive system 100. The construction material conveying unit 210 is designed for conveying construction material BS. The hydraulic drive system 100 is designed for driving the construction material conveying unit 210.

Figure 1:
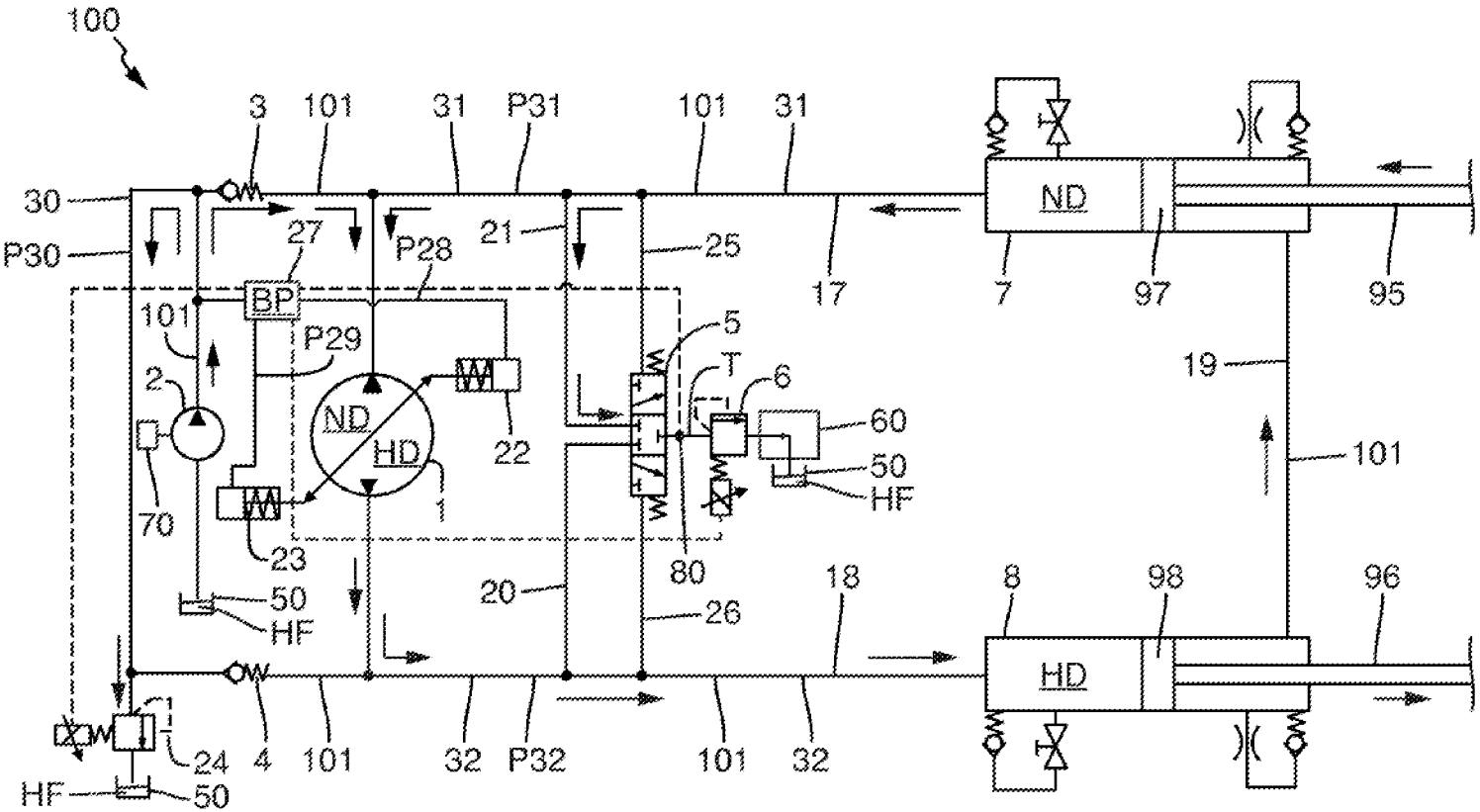
FIG. 1 shows a schematic circuit diagram of a hydraulic drive system according to an embodiment of the invention of a construction material pump according to an embodiment of the invention.

The hydraulic drive system 100 has a hydraulic circuit 101, a feed pump 2, at least one controllable pressure limiting valve unit 6, 24 and a control unit 27, as shown in FIG. 1. The hydraulic circuit 101 is designed for hydraulic fluid HF. The feed pump 2 is designed for feeding hydraulic fluid HF into the hydraulic circuit 101. The pressure limiting valve unit 6, 24 is designed for variably setting a limit pressure p30, p31/32 of hydraulic fluid HF of at least one section 30, 31, 32 of the hydraulic circuit 101 within a pressure range pmin, pmax. The control unit 27 is designed to control the pressure limiting valve unit 6, 24 in a manner dependent on at least one operating parameter BP of the hydraulic drive system 100 and/or of hydraulic fluid HF such that the pressure limiting valve unit 6, 24 sets the limit pressure p30, p31/32 of the section 30, 31, 32 of the hydraulic circuit 101.

In particular, the control unit 27 has an electrical signal connection to the pressure limiting valve unit 6, 24.

In detail, the at least one operating parameter BP is a drive state, a drive flow, a drive pressure, a drive rotational speed, a cooling flow, a temperature T and/or a degree of contamination.

The pressure range extends from a minimum of 10 bar pmin to a maximum of 35 bar pmax. In alternative exemplary embodiments, the pressure range may extend from a minimum of 2.5 bar to a maximum of 40 bar.

In the exemplary embodiment shown, the at least one pressure limiting valve unit 6, 24 has a controllable proportional pressure limiting valve. The proportional pressure limiting valve 6, 24 is designed for continuously setting the limit pressure p30, p31/32 of hydraulic fluid HF of the at least one section 30, 31, 32 of the hydraulic circuit 101 within the pressure range pmin, pmax. The control unit 27 is designed to control the proportional pressure limiting valve 6, 24 in a manner dependent on the at least one operating parameter BP such that the proportional pressure limiting valve 6, 24 sets the limit pressure p30, p31/32 of the section 30, 31, 32 of the hydraulic circuit 101.

In alternative exemplary embodiments, the at least one pressure limiting valve unit does not need to have a proportional pressure limiting valve, or the at least one pressure limiting valve unit may be of different design.

In the exemplary embodiment shown, the hydraulic drive system 100 has two controllable pressure limiting valve units 6, 24. In alternative exemplary embodiments, the hydraulic drive system does not need to have two controllable pressure limiting valve units, or the hydraulic drive system may have only a single controllable pressure limiting valve unit or may have at least three controllable pressure limiting valve units.

In particular, the hydraulic drive system may have an in particular controllable throttle valve unit, in particular a proportional throttle valve, in particular instead of the pressure limiting valve unit 6. The throttle valve unit may be designed for variably setting a flow of hydraulic fluid. The control unit may be designed to control the throttle valve unit in a manner dependent on the at least one operating parameter of the hydraulic drive system and/or of hydraulic fluid such that the throttle valve unit can set the flow.

In detail, the at least one section of the hydraulic circuit 101 has a feed pressure section 30 for hydraulic fluid HF. The pressure limiting valve unit 24 has a feed pressure limiting valve unit or is a feed pressure limiting valve unit. The feed pressure limiting valve unit 24 is designed for variably setting a feed limit pressure p30 of hydraulic fluid HF of the feed pressure section 30 within the pressure range pmin, pmax.

In the exemplary embodiment shown, the feed pump is designed for directly feeding hydraulic fluid HF from a container 50 of the hydraulic drive system 100 into the feed pressure section 30, as indicated by an arrow.

Furthermore, the at least one section of the hydraulic circuit 101 has at least one low pressure section 31, 32 for hydraulic fluid HF. The pressure limiting valve unit 6 has a controllable low pressure limiting valve unit or is a low pressure limiting valve unit. The low pressure limiting valve unit 6 is designed for variably setting a low limit pressure p31/32 of hydraulic fluid HF of the at least one low pressure section 31, 32 within the pressure range pmin, pmax. In alternative exemplary embodiments, the hydraulic drive system may have a, in particular the, throttle valve unit, in particular instead of the low pressure limiting valve unit.

In the exemplary embodiment shown, the feed pressure section 30 is designed for feeding hydraulic fluid HF into the low pressure section 31, 32, as indicated by an arrow, in particular by means of at least one infeed check valve 3, 4 of the hydraulic drive system 100.

Furthermore, in the exemplary embodiment shown, the hydraulic circuit 101 has two low pressure sections or high pressure sections or drive pressure sections 31, 32, respectively. Furthermore, the hydraulic drive system 100 has two infeed check valves 3, 4.

Furthermore, the hydraulic drive system 100 has a variably adjustable drive pump 1 and at least one hydraulic pressure-based actuator 22, 23, in particular in the form of an actuating cylinder. The drive pump 1 is designed for generating a variable drive flow with a variable drive pressure of hydraulic fluid HF in at least one, in particular the, drive pressure section 31, 32 of the hydraulic circuit 101. The actuator 22, 23 is designed for variably adjusting the drive pump 1 by means of a variable actuating pressure p28, p29 of hydraulic fluid HF. The at least one section 30, in particular the feed pressure section 30, of the hydraulic circuit 101 is designed for the hydraulic pressure supply of the at least one actuator 22, 23 with hydraulic fluid HF with the set limit pressure p30, in particular the set feed limit pressure p30, for the actuating pressure p28, p29. The control unit 27 is designed to control the at least one actuator 22, 23 in a manner dependent on the at least one operating parameter BP such that the at least one actuator 22, 23 adjusts the drive pump 1 for the generation of the variable drive flow with the variable drive pressure of hydraulic fluid HF in the at least one drive pressure section 31, 32.

In particular, the control unit 27 has a hydraulic signal connection to the at least one actuator 22, 23.

In the exemplary embodiment shown, the hydraulic drive system 100 has two hydraulic pressure-based actuators 22, 23.

In detail, the drive pump 1 is an axial piston pump with variably adjustable swashplate. The at least one actuator 22, 23 is designed for variably adjusting the swashplate.

Furthermore, the hydraulic drive system 100 has at least one drive cylinder 7, 8 and an associated drive piston 97, 98. The drive pump 1 is designed for moving the at least one drive piston 97, 98 by generating the drive flow of hydraulic fluid HF.

In the exemplary embodiment shown, the hydraulic drive system 100 has at least two, in particular exactly two, drive cylinders 7, 8 and respectively associated drive pistons 97, 98.

Additionally, the hydraulic drive system 100 has an oscillation line 19 for hydraulic fluid HF. The drive pump 1 and the two drive cylinders 7, 8 form, by means of the oscillation line 19, a closed drive circuit for hydraulic fluid HF. The two drive pistons 97, 98 are coupled, in particular in antiphase, by means of the oscillation line 19.

In detail, the two drive cylinders 7, 8 are connected by means of the oscillation line 19.

Additionally, the hydraulic drive system 100 has two pump lines 17, 18 for hydraulic fluid HF. The drive pump 1 and the drive cylinder 7 are connected by means of the pump line 17. The drive pump 1 and the drive cylinder 8 are connected by means of the pump line 18.

In detail, the drive pump 1 and the two drive cylinders 7, 8 form, by means of the oscillation line 19 and the two pump lines 17, 18, the closed drive circuit for hydraulic fluid HF.

In the exemplary embodiment shown, the drive state is on, an in particular required drive flow is relatively high, and an in particular required drive pressure is relatively high. Therefore, the feed limit pressure p30 has been set to in particular constant 32 bar. The low limit pressure p31 has been set to an in particular constant 30 bar.

The drive pump 1 or the closed drive circuit has a high pressure side HD and a low pressure side ND, which are cyclically interchanged with one another during operation of the hydraulic drive system 100 or of the construction material conveying unit 210. The drive pressure or high pressure HD is higher than the low limit pressure p31 or low pressure ND.

In FIG. 1, the high pressure side HD is at the bottom and the low pressure side is at the top.

Hydraulic fluid HF with the drive pressure or high pressure HD flows from the drive pump 1 through the pump line 18 to the drive cylinder 8, as indicated by an arrow. Here, the pump line 18 and the drive cylinder 8 in particular at least partially form the high pressure section 32.

Thus, the drive piston 98 moves in FIG. 1 to the right, as indicated by an arrow.

Hydraulic fluid HF, in particular with an oscillation pressure, flows from the drive cylinder 8 through the oscillation line 19 to the drive cylinder 7, as indicated by an arrow. Here, the oscillation line 19 and the drive cylinder 7 in particular at least partially form an oscillation pressure section.

Thus, the drive piston 97 moves in FIG. 1 to the left, as indicated by an arrow.

Hydraulic fluid HF with the low limit pressure p31 or low pressure ND flows from the drive cylinder 7 through the pump line 17 to the drive pump 1, as indicated by an arrow. Here, the pump line 17 and the drive cylinder 7 in particular at least partially form the low pressure section 31.

Here, the feed pressure section 30 feeds the low pressure section 31, as indicated by an arrow, in particular by means of the infeed check valve 3.

When the pistons 97, 98 have reached their end positions, the high pressure side HD and the low pressure side ND are interchanged. Then, the high pressure side HD is at the top and the low pressure side ND is at the bottom. Thus, the drive piston 98 moves to the left and the drive piston 97 moves to the right.

In alternative exemplary embodiments, the drive state may be on, but a drive flow may be medium and a drive pressure may be medium. Then, the feed limit pressure may be reduced to for example 22 bar and set in particular so as to be constant, and the low limit pressure may be lowered to for example 20 bar and set in particular so as to be constant.

Furthermore, in alternative exemplary embodiments, the drive state may be off. Then, the feed limit pressure may be reduced to for example 12 bar and set in particular so as to be constant and the low limit pressure may be lowered to for example 10 bar and set in particular so as to be constant.

Furthermore, the at least one pressure limiting valve unit 6, 24 is designed for variably setting the limit pressure p30, p31/32 by purging hydraulic fluid HF out of the hydraulic circuit 101, in particular into the container 50. In alternative exemplary embodiments, the at least one pressure limiting valve unit may be designed for variably setting the limit pressure by purging hydraulic fluid out of the hydraulic circuit, in particular through a filter and/or to the feed pump, in particular to a suction side of the feed pump.

In detail, the feed pressure limiting valve unit 24 is designed for variably setting the feed limit pressure p30 by purging hydraulic fluid HF out of the feed pressure section 30, as indicated by an arrow.

In FIG. 1, a proportion of the hydraulic fluid HF flows out of the feed pressure section 30 into the low pressure section 31. Another proportion of the hydraulic fluid HF is purged out of the feed pressure section 30.

The low pressure limiting valve unit 6 is designed for variably setting the low limit pressure p31/32 by purging hydraulic fluid HF out of the low pressure section 31, 32, as indicated by an arrow.

In alternative exemplary embodiments, the hydraulic drive system may have a, in particular the, throttle valve unit, in particular instead of the low pressure limiting valve unit. The throttle valve unit may be designed for variably setting a flow, in particular a purge flow, of hydraulic fluid out of the low pressure section. The control unit may be designed to control the throttle valve unit in a manner dependent on the at least one operating parameter of the hydraulic drive system and/or of hydraulic fluid such that the throttle valve unit can set the flow of hydraulic fluid out of the low pressure section.

In FIG. 1, a proportion of the hydraulic fluid HF flows from the low pressure section 31 to the drive pump 1. Another proportion of the hydraulic fluid HF is purged out of the low pressure section 31.

In detail, the hydraulic drive system 100 has a shuttle-type purge valve 5. The low pressure section 31, 32 and the low pressure limiting valve unit 6 are connected by means of the shuttle-type purge valve 5 for a flow of hydraulic fluid HF. In other words: in FIG. 1, hydraulic fluid HF flows from the low pressure section 31 through the shuttle-type purge valve 5 to the low pressure limiting valve unit 6, as indicated by an arrow.

In particular, the hydraulic drive system 100 has two in particular hydraulic control lines 25, 26 for the in particular automatic control of the shuttle-type purge valve 5.

In detail, the hydraulic drive system 100 has two purge lines 20, 21 for hydraulic fluid HF. The pump line 17 and the shuttle-type purge valve 5 are connected by means of the purge line 21. The pump line 18 and the shuttle-type purge valve 5 are connected by means of the purge line 20. Furthermore, the shuttle-type purge valve 5 is designed to connect that purge line 20, 21 which has a relatively low pressure in relation to the other purge line, in FIG. 1 the purge line 21, to the low pressure limiting valve unit 6, in particular for a flow of hydraulic fluid HF from the respective purge line 20, 21 to the low pressure limiting valve unit 6.

Furthermore, the hydraulic drive system 100 has a cooler 60. The cooler 60 is designed for cooling hydraulic fluid HF. The at least one pressure limiting valve unit 6, 24 is designed for variably setting a, in particular the, cooling flow of hydraulic fluid HF via the cooler 60 by setting the limit pressure p30, p31/32. The control unit 27 is designed to control the pressure limiting valve unit 6, 24 in a manner dependent on the at least one operating parameter BP, in particular the temperature T, such that the pressure limiting valve unit 6, 24 sets the cooling flow of hydraulic fluid HF via the cooler 60.

In alternative exemplary embodiments, the hydraulic drive system may have a, in particular the, throttle valve unit, in particular instead of the pressure limiting valve unit 6. The throttle valve unit may be designed for variably setting a, in particular the, cooling flow of hydraulic fluid via the cooler. The control unit may be designed to control the throttle valve unit in a manner dependent on the at least one operating parameter, in particular the temperature, such that the throttle valve unit can set the cooling flow of hydraulic fluid via the cooler.

In detail, the cooling flow is set by way of a pressure difference between the feed limit pressure p30 and the low limit pressure p31/32.

In the exemplary embodiment shown, the temperature T is medium. The pressure difference has therefore been set to an in particular constant 2 bar. In alternative exemplary embodiments, the temperature may be relatively high. Then, the pressure difference may be increased to for example 3 bar and set in particular so as to be constant. In particular, the low limit pressure may be lowered in particular relative to the feed limit pressure and set in particular so as to be constant. Furthermore, in alternative exemplary embodiments, the temperature may be relatively low. Then, the pressure difference may be reduced to for example 1 bar and set in particular so as to be constant. In particular, the low limit pressure may be increased in particular relative to the feed limit pressure and set in particular so as to be constant.

In the exemplary embodiment shown, the hydraulic drive system 100 is designed for purging the cooling flow out of the hydraulic circuit 101, in particular out of the low pressure section 31, 32, via the cooler 60. In other words: the cooler 60 is, in particular in a flow direction, arranged after or downstream of the low pressure limiting valve unit 6, and in particular upstream of the container 50. In other words: hydraulic fluid HF flows from the low pressure limiting valve unit 6 via or through the cooler 60 to the container 50, as indicated by an arrow. In alternative exemplary embodiments, the hydraulic drive system may be designed for purging the cooling flow out of the hydraulic circuit, in particular out of the low pressure section, via the cooler, in particular through a, in particular the, filter and/or to the feed pump, in particular to a, in particular the, suction side of the feed pump. In other words: hydraulic fluid can flow from the low pressure limiting valve unit via or through the cooler and in particular a, in particular the, filter to the feed pump, in particular to a, in particular the, suction side of the feed pump. Additionally or alternatively, in alternative exemplary embodiments, the hydraulic drive system may have a, in particular the, throttle valve unit, in particular instead of the low pressure limiting valve unit.

Furthermore, the hydraulic drive system 100 has at least one measuring sensor 80. The measuring sensor 80 is designed for measuring at least one property of the hydraulic drive system 100 and/or of hydraulic fluid HF. The control unit 27 is designed for determining the at least one operating parameter BP in a manner dependent on the measured property.

In particular, the control unit 27 has an electrical signal connection to the measuring sensor 80.

In the exemplary embodiment shown, the hydraulic drive system 100 has only a single measuring sensor 80. In alternative exemplary embodiments, the hydraulic drive system may have at least two measuring sensors.

Furthermore, in the exemplary embodiment shown, the measuring sensor 80 is designed for measuring a temperature T of hydraulic fluid HF and thus of the hydraulic drive system 100. The control unit 27 is designed for determining the at least one operating parameter BP in a manner dependent on the measured temperature T.

In detail, the measuring sensor 80 is designed for measuring the temperature T of hydraulic fluid HF in the low pressure section 31, 32. In other words: the measuring sensor 80 is, in particular in a flow direction, arranged in particular downstream of the shuttle-type purge valve 5 and upstream of the low pressure limiting valve unit 6. In alternative exemplary embodiments, the measuring sensor may be arranged at or in the drive pump, in particular in the leakage oil of the drive pump.

Furthermore, the hydraulic drive system 100 has a drive motor 70. The drive motor 70 is designed for driving the feed pump 2 and in particular additionally the drive pump 1.

Figure 2:
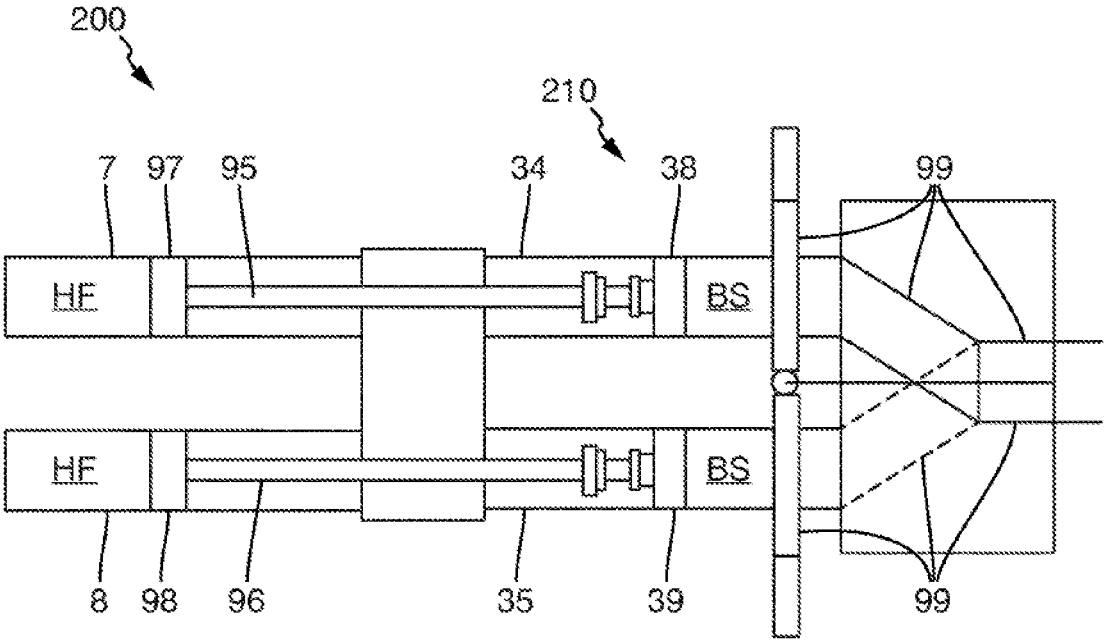
FIG. 2 shows a schematic circuit diagram of a detail of the hydraulic drive system of FIG. 1 and of a construction material conveying unit of the construction material pump.

Furthermore, the construction material conveying unit 210 has at least one, in particular two, conveying cylinders 34, 35 and one, in particular two, associated conveying pistons 38, 39 in particular arranged in the conveying cylinder 34, 35, as shown in FIG. 2. In particular, the at least one conveying cylinder 34, 35 is designed for construction material BS. The at least one conveying cylinder 34, 35 is designed for applying pressure to construction material BS.

Additionally, the hydraulic drive system 100 has at least one, in particular two, piston rods 95, 96. The at least one piston rod 95, 96 is designed for coupling of movement or transmission of movement of the at least one drive piston 97, 98 to the at least one conveying piston 38, 39. In particular, the at least one piston rod 95, 96 is fastened to the at least one drive piston 97, 98 and/or to the at least one conveying piston 38, 39.

Furthermore, the construction material conveying unit 210 has a pipe switch system 99.

As is made clear by the exemplary embodiments shown and discussed above, the invention provides an advantageous hydraulic drive system for a construction material pump and an advantageous construction material pump having such a hydraulic drive system, which hydraulic drive system and construction material pump each have improved properties, in particular allow a saving of energy or power.

What is claimed is:

1. A hydraulic drive system for a construction material pump, the hydraulic drive system comprising:

a hydraulic circuit for hydraulic fluid;

a feed pump which is designed for feeding hydraulic fluid into the hydraulic circuit;

at least one controllable pressure limiting valve unit which is designed for variably setting a limit pressure of hydraulic fluid of at least one section of the hydraulic circuit within a pressure range;

a control unit which is designed to control the pressure limiting valve unit in a manner dependent on at least one operating parameter of the hydraulic drive system and/or of hydraulic fluid such that the pressure limiting valve unit sets the limit pressure of the section of the hydraulic circuit; and a cooler which is designed for cooling hydraulic fluid, wherein the at least one pressure limiting valve unit is designed for variably setting a cooling flow of hydraulic fluid via the cooler by setting the limit pressure, and wherein the control unit is designed to control the pressure limiting valve unit in a manner dependent on the at least one operating parameter such that the pressure limiting valve unit sets the cooling flow of hydraulic fluid via the cooler.

2. The hydraulic drive system as claimed in claim 1, further comprising:

a drive motor which is designed for driving the feed pump.

3. The hydraulic drive system as claimed in claim 1, wherein the at least one operating parameter is a drive state, a drive flow, a drive pressure, a drive rotational speed, a cooling flow, a temperature and/or a degree of contamination.

4. The hydraulic drive system as claimed in claim 1, wherein the pressure range extends from a minimum of 2.5 bar to a maximum of 40 bar.

5. The hydraulic drive system as claimed in claim 1, wherein the pressure range extends from a minimum of 15 bar to a maximum of 25 bar.

6. The hydraulic drive system as claimed in claim 1, wherein the at least one pressure limiting valve unit has a controllable proportional pressure limiting valve which is designed for continuously setting the limit pressure of hydraulic fluid of the at least one section of the hydraulic circuit within the pressure range, and the control unit is designed to control the proportional pressure limiting valve in a manner dependent on the at least one operating parameter such that the proportional pressure limiting valve sets the limit pressure of the section of the hydraulic circuit.

7. The hydraulic drive system as claimed in claim 1, wherein the at least one section of the hydraulic circuit has a feed pressure section for hydraulic fluid, and the at least one pressure limiting valve unit has a controllable feed pressure limiting valve unit which is designed for variably setting a feed limit pressure of hydraulic fluid of the feed pressure section within the pressure range.

8. The hydraulic drive system as claimed in claim 1, further comprising:

a variably adjustable drive pump which is designed for generating a variable drive flow with a variable drive pressure of hydraulic fluid in at least one drive pressure section of the hydraulic circuit; and at least one hydraulic pressure-based actuator which is designed for variably adjusting the drive pump by way of a variable actuating pressure of hydraulic fluid, wherein the at least one section of the hydraulic circuit is designed for supplying hydraulic pressure to the at least one actuator with hydraulic fluid with the set limit pressure for the actuating pressure, and wherein the control unit is designed to control the at least one actuator in a manner dependent on the at least one operating parameter such that the at least one actuator adjusts the drive pump for the generation of the variable drive flow with the variable drive pressure of hydraulic fluid in the at least one drive pressure section.

9. The hydraulic drive system as claimed in claim 8, wherein the drive pump is an axial piston pump with variably adjustable swashplate, and the at least one actuator is designed for variably adjusting the swashplate.

10. The hydraulic drive system as claimed in claim 8, further comprising:

at least one drive cylinder and an associated drive piston, wherein the drive pump is designed for variably moving the at least one drive piston by generating the drive flow of hydraulic fluid.

11. The hydraulic drive system as claimed in claim 10, further comprising:

at least two drive cylinders and respectively associated drive pistons; and an oscillation line for hydraulic fluid, wherein the drive pump and the two drive cylinders form, by way of the oscillation line, a closed drive circuit for hydraulic fluid, and wherein the two drive pistons are coupled by way of the oscillation line.

12. The hydraulic drive system as claimed in claim 1, wherein the at least one section of the hydraulic circuit has at least one low pressure section for hydraulic fluid, and the at least one pressure limiting valve unit has a controllable low pressure limiting valve unit which is designed for variably setting a low limit pressure of hydraulic fluid of the at least one low pressure section within the pressure range.

13. The hydraulic drive system as claimed in claim 1, wherein the at least one pressure limiting valve unit is designed for variably setting the limit pressure by purging hydraulic fluid out of the hydraulic circuit.

14. The hydraulic drive system as claimed in claim 1, further comprising:

at least one measuring sensor which is designed for measuring at least one property of the hydraulic drive system and/or of hydraulic fluid, wherein the control unit is designed for determining the at least one operating parameter in a manner dependent on the measured property.

15. A construction material pump, comprising:

a construction material conveying unit which is designed for conveying construction material; and a hydraulic drive system as claimed in claim 1, wherein the hydraulic drive system is designed for driving the construction material conveying unit.

16. A hydraulic drive system for a construction material pump, the hydraulic drive system comprising:

a hydraulic circuit for hydraulic fluid;

a feed pump which is designed for feeding hydraulic fluid into the hydraulic circuit;

at least one controllable pressure limiting valve unit which is designed for variably setting a limit pressure of hydraulic fluid of at least one section of the hydraulic circuit within a pressure range;

a control unit which is designed to control the pressure limiting valve unit in a manner dependent on at least one operating parameter of the hydraulic drive system and/or of hydraulic fluid such that the pressure limiting valve unit sets the limit pressure of the section of the hydraulic circuit;

at least one measuring sensor which is designed for measuring at least one property of the hydraulic drive system and/or of hydraulic fluid, wherein the control unit is designed for determining the at least one operating parameter in a manner dependent on the measured property, and wherein the at least one property is a temperature and/or a degree of contamination.

* * * * *